US007780425B2

(12) United States Patent
Kreuter et al.

(10) Patent No.: US 7,780,425 B2
(45) Date of Patent: Aug. 24, 2010

(54) PISTON COMPRESSOR

(75) Inventors: Peter Kreuter, Aachen (DE); Armin Zoschke, Herzogenrath (DE)

(73) Assignee: META Motoren-und Energie-Technik GmbH, Herzogenrath (DE)

( * ) Notice: Subject to any disclaimer, the term of this patent is extended or adjusted under 35 U.S.C. 154(b) by 1199 days.

(21) Appl. No.: 11/019,113

(22) Filed: Dec. 22, 2004

(65) Prior Publication Data

US 2005/0152798 A1 Jul. 14, 2005

(30) Foreign Application Priority Data

Dec. 23, 2003 (DE) ..... 103 60 920

(51) Int. Cl.
*F04B 39/10* (2006.01)
*F04B 53/10* (2006.01)

(52) U.S. Cl. ..... 417/534

(58) Field of Classification Search ..... 417/534, 417/364, 521, 415; 92/138, 184, 185
See application file for complete search history.

(56) References Cited

U.S. PATENT DOCUMENTS 1,474,769 A * 11/1923 Dunning ..... 417/534
2,135,247 A * 11/1938 Aikman ..... 417/281
2,514,223 A * 7/1950 Covins ..... 92/80
3,233,554 A * 2/1966 Huber et al. ..... 417/262
3,977,303 A * 8/1976 Baker ..... 91/493
4,072,210 A * 2/1978 Chien ..... 184/5
4,111,609 A 9/1978 Braun
4,373,876 A * 2/1983 Nemoto ..... 417/534
4,400,144 A * 8/1983 Drutchas et al. ..... 417/415
4,485,769 A * 12/1984 Carson ..... 123/61 R
4,486,157 A * 12/1984 Hayashi ..... 417/534
4,651,525 A * 3/1987 Cestero ..... 60/416
4,729,291 A * 3/1988 Miller ..... 92/138
4,941,396 A * 7/1990 McCabe ..... 92/136
4,957,416 A * 9/1990 Miller et al. ..... 417/273
5,219,273 A 6/1993 Chang
5,482,443 A * 1/1996 Bez ..... 417/266
5,638,738 A * 6/1997 Sell ..... 92/138
5,782,616 A * 7/1998 Yoo ..... 417/364
6,644,940 B2 * 11/2003 Yamada ..... 417/393

FOREIGN PATENT DOCUMENTS

WO WO 03/087577 A 10/2003

* cited by examiner

*Primary Examiner*—Devon C Kramer
*Assistant Examiner*—Amene S Bayou
(74) *Attorney, Agent, or Firm*—Muncy, Geissler, Olds & Lowe, PLLC

(57) ABSTRACT

A piston compressor contains at least one cylinder (2), inside of which a reciprocating piston (4) forms two working chambers (10, 12) disposed on opposing sides of the piston, which each have at least one inlet and one outlet opening, in which a respective inlet valve (20, 22) or an outlet valve (24, 26) operates. A housing (32) surrounds the cylinder, and has a suction port (34) and an exhaust port (36). A space between the cylinder and the housing is divided by a separating wall (28, 30) in such a way as to connect the suction port with the inlet openings and the exhaust port with the outlet openings. A driving arrangement (42, 44) reciprocally moves the piston. The inlet valve of one working chamber opens and the inlet valve of the other working chamber closes for each stroke of the piston, and the outlet valve of the one working chamber closes, while the outlet valve of the other working chamber opens.

8 Claims, 5 Drawing Sheets

72
64
56
44
70
62
24
68
20
66
54
42

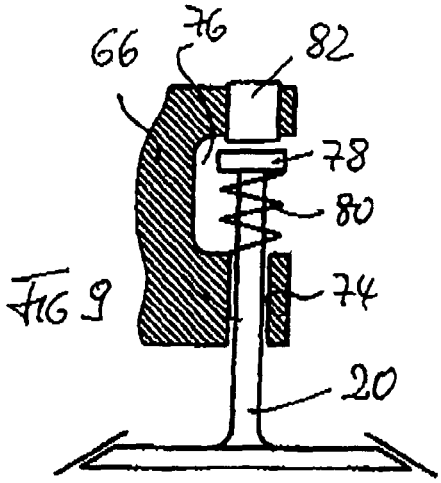
FIG 9
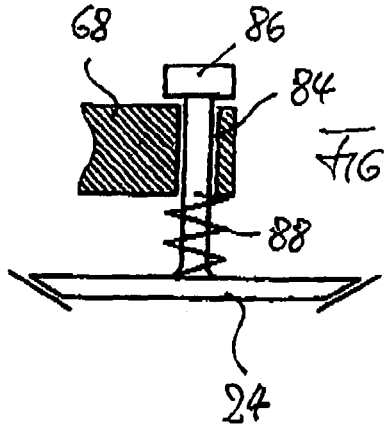
FIG 10
FIG 11
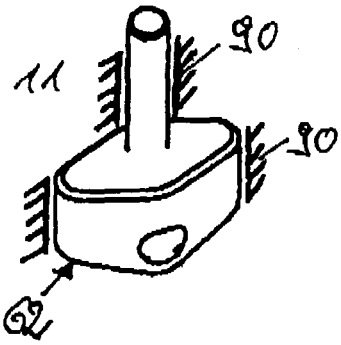
FIG 12
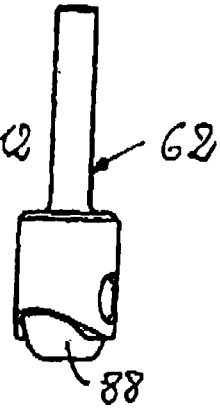
FIG 13
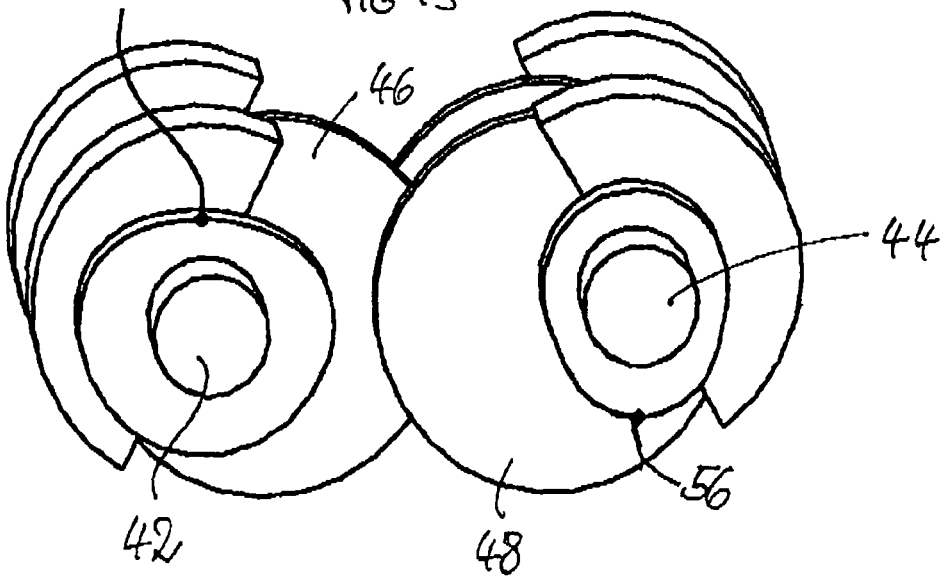

PISTON COMPRESSOR

This application claims priority to German patent application No. 103 60 920.2, the contents of which are incorporated herein by reference.

TECHNICAL FIELD

The invention relates to a piston compressor that is particularly suitable for charging an internal combustion engine.

BACKGROUND ART

Charging internal combustion engines is not only a proven way to increase torque and power, but also to reduce consumption during the partial load operation of an internal combustion engine with a predetermined maximum capacity. It is particularly advantageous to charge diesel engines, since the knocking problems that persist in spark ignition engines do not exist in diesel engines.

There are basically two different charging methods, which can also be used in combination. In exhaust gas turbocharging, the energy contained in the exhaust gas of an internal combustion engine is used to power a turbocharger, which drives a turbine that supplies compressed air to the internal combustion engine. During so-called independent supercharging, the compressor is powered by a separate drive, e.g., the crankshaft of the internal combustion engine to be charged, or another engine, e.g., an electric engine, in order to compress the air supplied to the internal combustion engine. There are various known types of independently driven compressors, e.g., Roots supercharger blowers, spiral chargers or piston compressors.

U.S. Pat. No. 4,111,609 discloses a compact fluid compressor.

SUMMARY

The object of the invention is to provide a piston compressor that is distinguished by having a highly efficient and simple design, and can be used for various applications.

The object is achieved by a piston compressor according to claim 1.

The subclaims relate to advantageous embodiments and further developments of the piston compressor according to the invention.

The invention will be described in greater detail below based on the drawings, by example and with additional details.

BRIEF DESCRIPTION OF THE DRAWINGS

FIG. 9 is an inlet valve that interacts with a valve element;

FIG. 10 is an outlet valve that interacts with a valve element;

FIG. 11 is a perspective view of a roller tappet;

FIG. 12 is a perspective view of the roller tappet according to FIG. 11 from another perspective;

FIG. 13 is a detailed view of the cam and crank mechanism; and

DETAILED DESCRIPTION OF THE INVENTION

Figure 1:
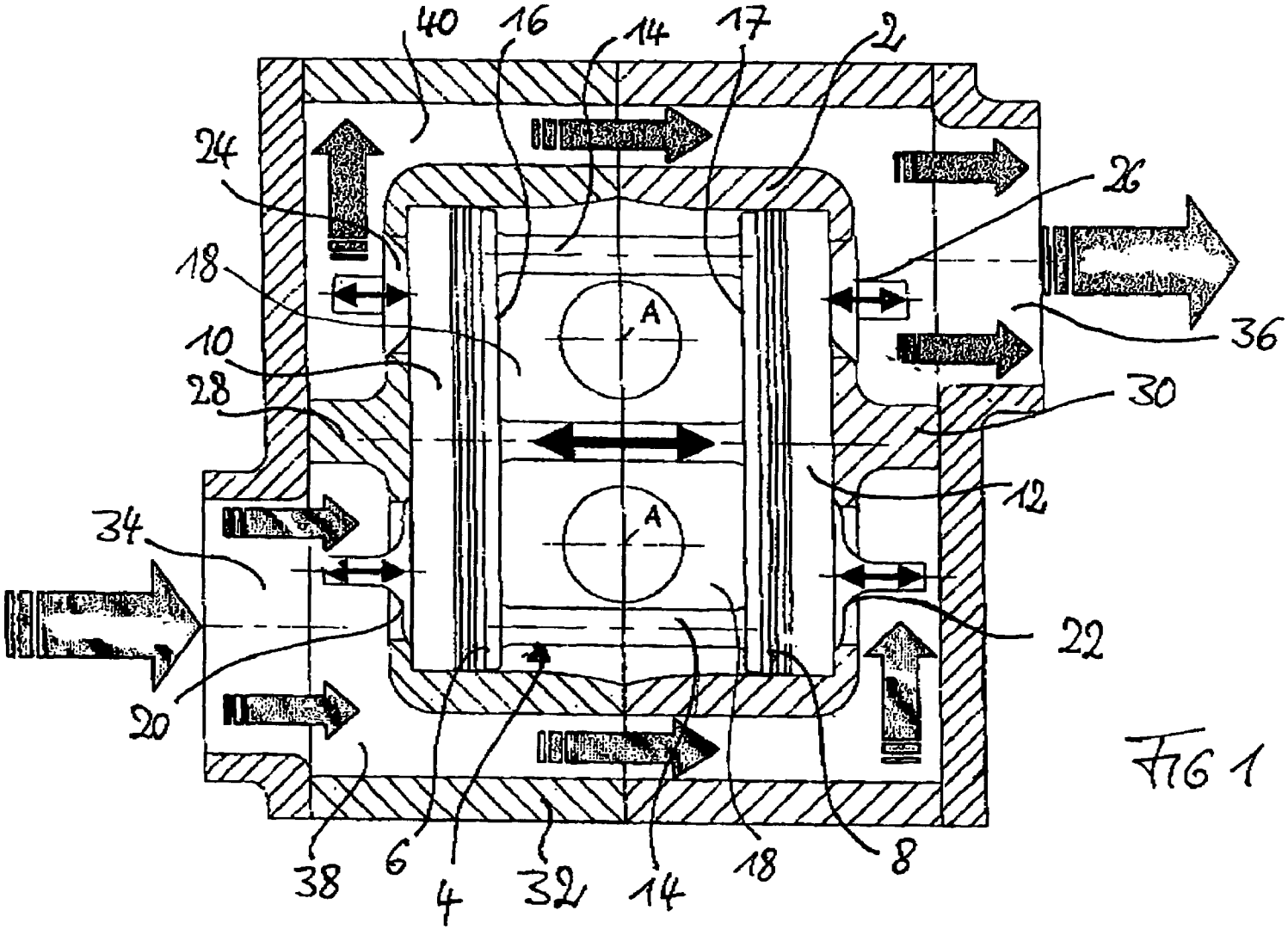
FIG. 1 is a diagrammatic cross section through a representative piston compressor.

Referring to FIG. 1, a piston compressor according to the present teachings has a cylinder 2 sealed on both sides by front walls, in which cylinder 2 a piston 4 can be reciprocally moved. The piston 4 comprises two spaced apart piston heads 6 and 8, which advantageously are fitted with piston rings on their peripheral edges for sealing purposes, and which separate two working chambers 10 and 12 inside the cylinder 2. The two piston heads 6 and 8 are rigidly connected by braces 14, e.g., by being screwed together. The facing interior sides of the piston heads 6 and 8 are provided with guiding surfaces 16 and 17, which are used for guiding sliding blocks 18.

The front walls of the cylinder 2 have openings for at least one respective inlet valve 20 or 22 and outlet valve 24 or 26.

The cylinder 2 is incorporated in a housing 32 by means of mounting devices that form separating walls 28 and 30, The housing 32 has at least one suction port 34 and an exhaust port 36. A space is formed between the housing 32 and the cylinder 2 and is divided by the separating walls 28 and 30 in such a way as to form an inlet channel 38 that joins the suction port 34 with the inlet valves 20 and 22 or optionally opened or closed inlet holes thereof leading into the working chambers 10 and 12. An outlet channel 40 joins the outlet valves 24, 26 or optionally opened or closed outlet holes of the working chambers 10 and 12 with the exhaust port 36.

The piston 4 moves in the horizontal direction of FIG. 1. It is vertical in FIG. 2 to 8, so that the depictions on FIG. 2 to 8 are rotated by 90° relative to the arrangement according to FIG. 1.

Figure 2:
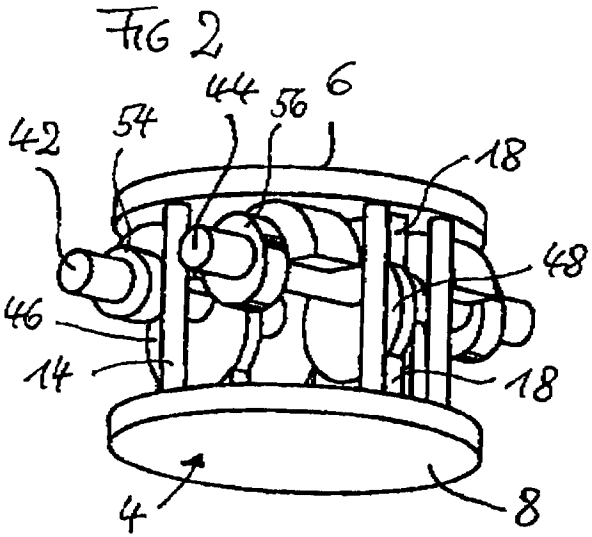
FIGS. 2 and 3 are different perspective views of a piston with crankshafts passing through the piston.
Figure 3:
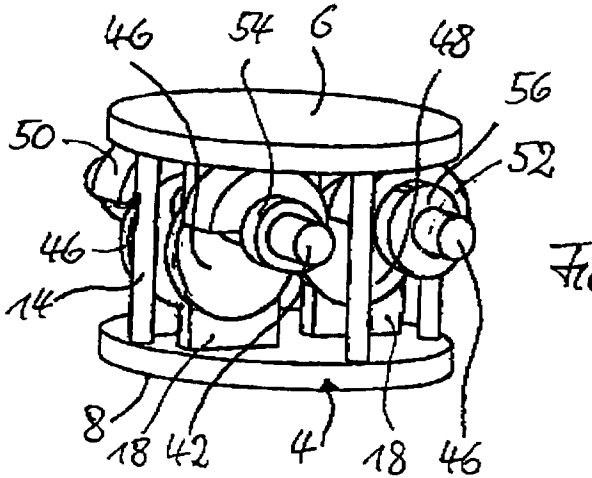

FIGS. 2 and 3 show perspective views of the piston 4 with two respective crankshafts 42 and 44 that pass through the piston 4. The crankshaft axes are fixed relative to the cylinder 2 and/or housing 32, and are marked A in FIG. 1. Each crankshaft 42, 44 has at least one crank disk 46 and/or 48, which is(are) arranged eccentrically to the longitudinal axis. The crank disks 46, 48 cooperate with the sliding blocks 18, which are linearly movable along the guiding surfaces 16, 17 of the piston heads 6 and 8 perpendicular to the crankshaft axes, thereby creating a sliding block guide or a crank guide. As a result, the rotating, eccentric motion of the crank disks 46, 48 can be converted in a known manner into an oscillating motion of the piston 4 inside the cylinder 2. The sliding blocks 18 are advantageously sectionalized for easy assembly.

Figure 4:
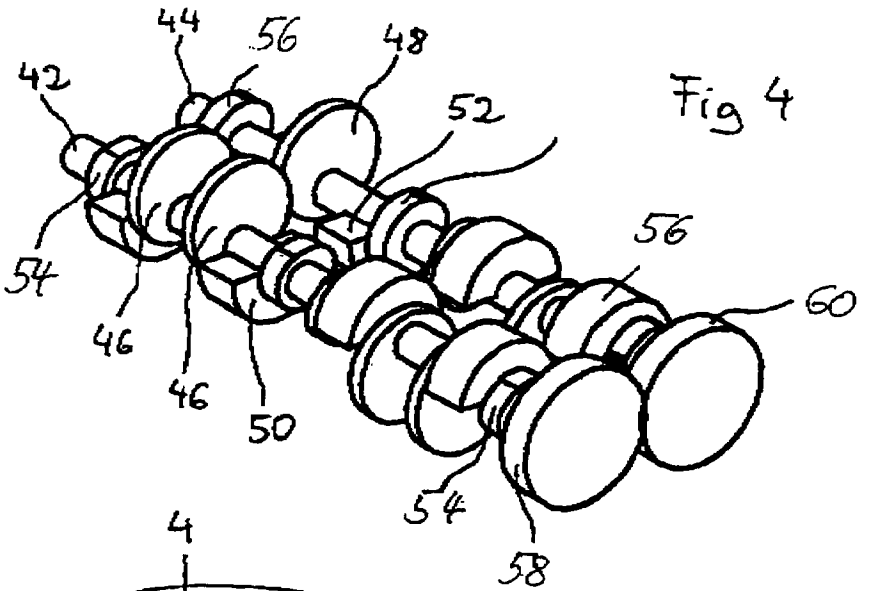
FIG. 4 is a perspective view of two crankshafts for a two-cylinder piston compressor.

FIG. 4 shows the crankshafts 42 and 44 as designed for two cylinders 2 arranged one in back of the other inside the housing 32 (FIG. 1), in which a respective piston 4 operates. In the shown example, two crank disks 46 are disposed on the crankshaft 42 of each piston 4, and one crank disk 48 is disposed on the crankshaft 44 of each piston 4. As evident, the crank disks 46 and 48 are axially offset relative to each other, so that their paths of motion radially intersect, thereby enabling a smaller distance to be defined between the crankshafts 42 and 44. The oscillating forces are balanced by providing the crankshafts 42 and 44 with balancing masses 50 and 52 in a known manner.

The crankshafts 42 and 44 can each be mounted in the wall of the cylinder 2, for example.

In order to drive the valves 20, 22, 24 and 26, the crankshafts 42, 44 have cams 54 and 56, which actuate the valves via actuating elements. One or more toothed wheels 58 and/or 60 is connected in a torsion-resistant manner with the respective crankshaft at one respective end of the crankshaft, so that only one of the crankshafts 42, 44 is required to be externally driven. The toothed wheels 58 and 60 are the same size and intermesh, so that the crankshafts 42 and 44 rotate oppositely at the same speed. The toothed wheels 58, 60 are advantageously used as elements of a gear pump, which is situated in a coolant and/or lubricant circulating in the compressor.

Figure 5:
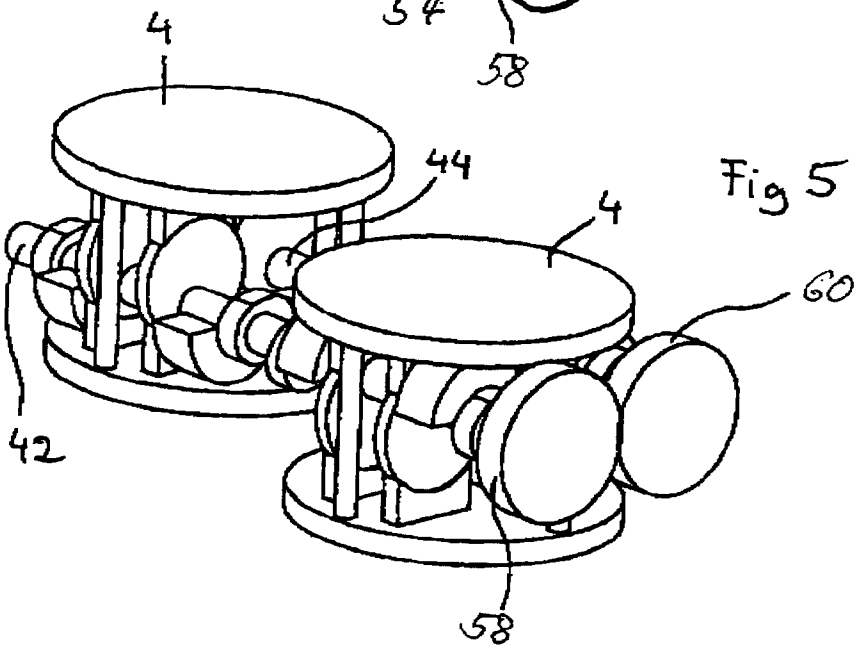
FIG. 5 are the crankshafts according to FIG. 4 with accompanying pistons.

FIG. 5 shows the piston assembled with the crankshafts according to FIG. 4.

Figures 6, 7, 8:
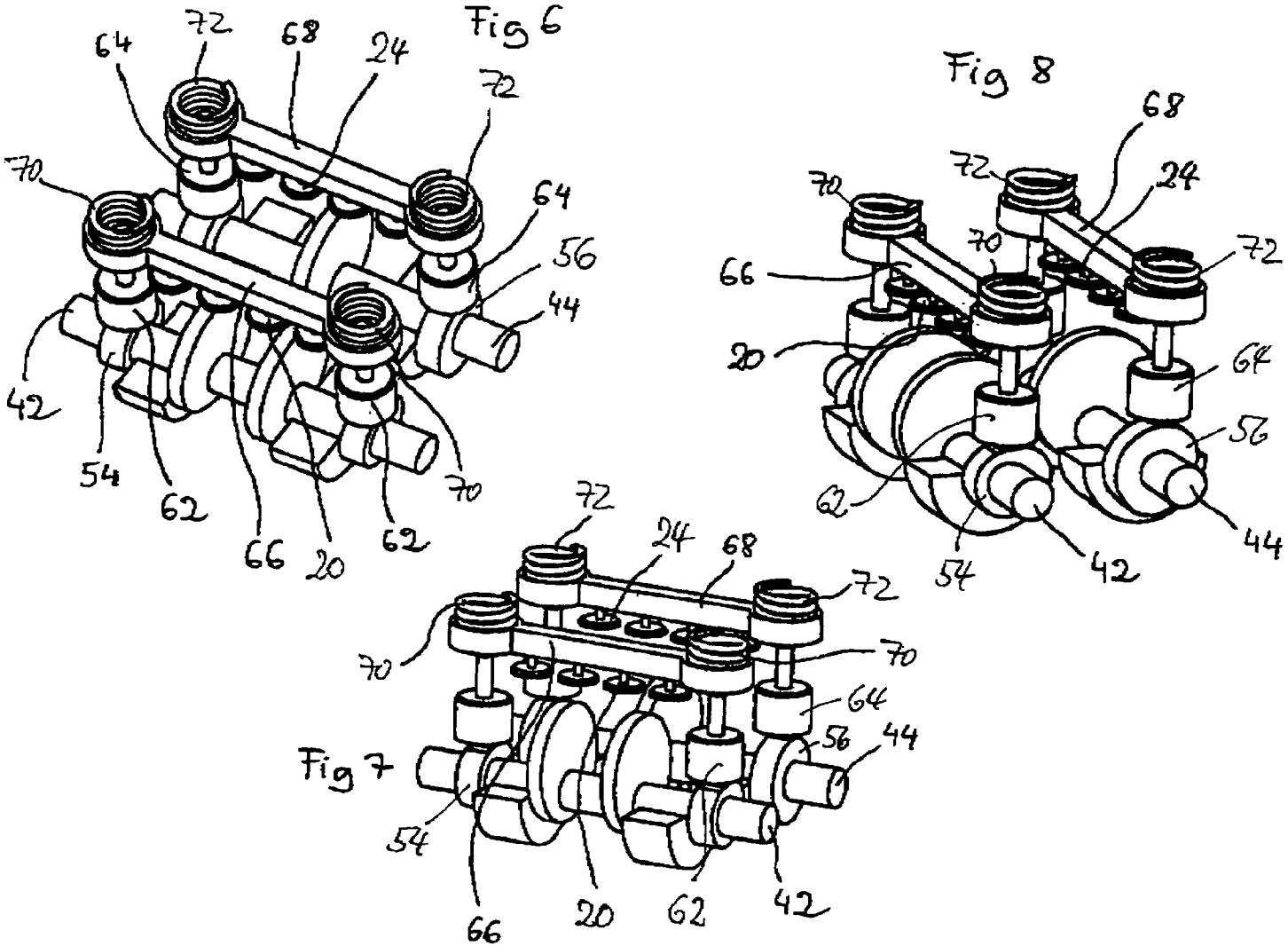
FIG. 6 to 8 are different perspective views of a crank/valve mechanism located on one side of the crankshafts and allocated to a cylinder.

FIG. 6 shows a perspective view of sections of a crank/valve mechanism arranged on the left of the crankshafts 42, 44 according to the figure, and assigned to a cylinder.

In the shown example, both sides of each crankshaft 42 and/or 44 have cams 54 and/or 56 outside the cylinder, which interact with roller tappets 62 and/or 64, which each actuate a valve element 66 and/or 68 that bridges over a cylinder. The left valve element 66 according to FIG. 6 actuates several inlet valves 20 (FIG. 1). The right valve element 68 actuates several outlet valves 24. In the shown example, the valves are restrictedly guided at the respective valve elements. Four inlet valves and four outlet valves are arranged on the front wall of the cylinder 2 in the shown example, and are actuated by means of one valve element each.

As evident from FIG. 1, because the inlet valves 20, 22 and the outlet valves 24, 26 each lie opposite of each other, the valve mechanisms arranged on the left and/or right (FIG. 1) or above and/or below the pistons (FIG. 2 to 8) are identically configured, or exhibit a mirror symmetry.

When operating the compressor in a two-stroke operating mode, the inlet valves and outlet valves are each phase-shifted by about 180° relative to the crankshaft rotation upon actuation. As a result, an in-phase actuation of the respective valves is provided during the opposite rotation of the adjacent crankshafts 42, 44 at the same speed when the cams 54, 56 are properly designed.

The valve mechanism will be described in greater detail below based on FIG. 9 to 13.

The valve elements 66 and/or 68 are guided in a linearly moveable manner within guides fixed to the housing (not shown), and reciprocally moved in the cams 54 and/or 56 against the force applied by springs 70 and/or 72, which are supported between the housing 32 and the respective valve element.

The bridge-like valve element 66 (FIG. 9), which actuates the outlet valves 20, contains a guide passage 74 for each outlet valve 20. The shaft of the outlet valve 20 extends through the guide passage 74, which leads into a recess 76 where the valve shaft ends. A valve spring 80 is supported between the end flange 78 of the valve shaft and the valve element 66, thereby biasing the outlet valve 20 into the closed position. A stud screw 82 is screwed into the valve element 66 opposite the end flange 82, and used for adjusting the amount of play.

The valve element 68 that actuates the outlet valves 24 also has a guide passage 84 (FIG. 10), through which the valve stem extends. The valve stem 84 ends in a stop, e.g., usually screwed to it, and its distance from the valve head is adjustable to regulate the amount of play. A valve spring 88 is supported between the valve element 68 and the valve.

As a result of the structural design illustrated in FIGS. 9 and 10, which can be modified in a variety of ways, rigid-casing guidance is not required for the valve stems. Further, the inlet valves 20 according to FIG. 9 each open downwardly relative to the valve element when the valve element 66 moves toward the bottom. Moreover, the outlet valves 24 according to FIG. 10 open upwardly when the valve element 68 moves toward the top. In addition, the springs 80 and 88 can be dimensioned in such a way that the inlet valve 20 opens in response to a strong underpressure (vacuum) in the accompanying working chamber, without the valve element 66 being moved, and/or that the outlet valve 24 opens in response to a strong overpressure in the accompanying working chamber, without the valve element 68 being moved.

FIGS. 11 and 12 show a roller tappet 62 with a roll 88 and a casing-fixed guide 90 accommodated therein.

FIG. 13 shows a section of the two crankshafts 42 and 44 with the cams 54 and 56. Contrary to the embodiment according to FIG. 6 to 8, the crankshaft 42 of FIG. 13 has only one crank disk 46, while the crankshaft 44 has two crank disks 48. Therefore, the cams that actuate the roller tappet or bridge element 66 allocated to the inlet valves are designed as "negative cams", which normally presses the bridge element 66 against the springs 70 in the position according to FIG. 9. The cams initiate a downward motion of the valve element 66 that occurs only in its cam area designed with a smaller diameter according to FIG. 8 in order to open the inlet valve 20. The cam 56 of the crankshaft 44 allocated to the outlet valves is designed as a normal cam with a cam pitch of increased diameter.

The representative piston compressor is assembled as follows:

The actual driving mechanism as shown on FIG. 5 is first assembled by arranging the crankshafts 42, 44 and sliding blocks 18 on two respectively adjacent piston heads 6, and then mounting the respective other piston heads 8 using the braces 14, thereby resulting in the module according to FIG. 5.

The cylinders 2, which each consist of two centrally divided halves, are then attached over the piston 4. The valve mechanisms are then mounted in assembly surfaces secured to the cylinders, and the entire arrangement is put together in the housing 32, which also consists of two parts. The cylinder halves and the housing halves can be integrally designed.

Figure 14:
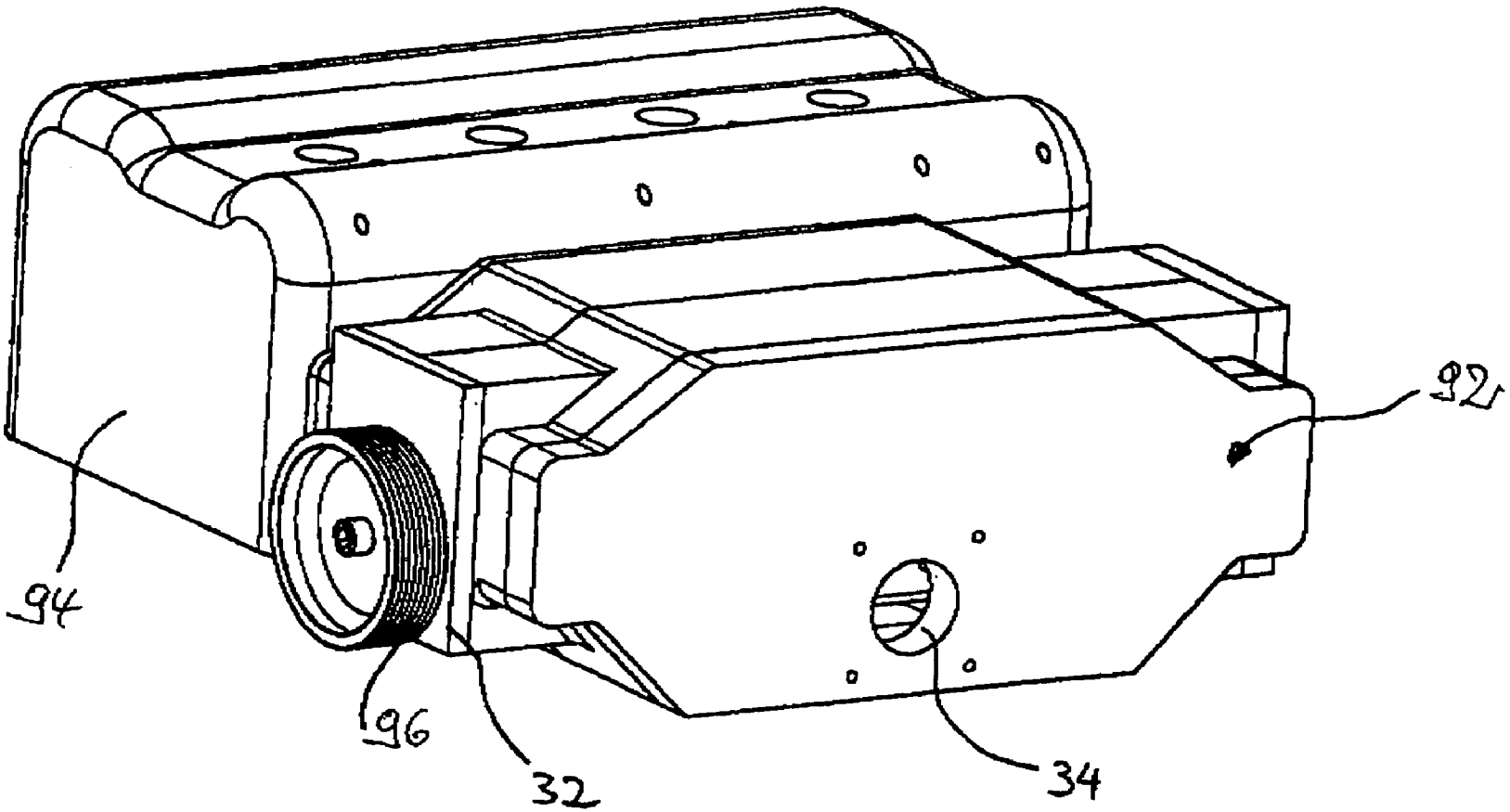
FIG. 14 is a perspective view of a representative compressor connected to the cylinder head of an internal combustion engine.

FIG. 14 shows a piston compressor 92 according to the present teachings attached to the suction side of a crankcase or cylinder head 94 of an internal combustion engine. Reference number 96 denotes a belt pulley for driving one of the crankshafts.

The suction port 34 of the housing 32 can also have attached to it a suction module (not shown), e.g., containing a throttle valve and/or a device for measuring the intake air quantity, etc.

The representative compressor operates as follows:

The compressor is preferably operated in the two-stroke operating mode. As the piston 4 according to FIG. 1 moves from left to right, the inlet valve 20 and outlet valve 26 are actuated in such a way that fresh air is drawn into the working chamber 10, and compressed fresh air is exhausted from the working chamber 20 at appropriate pressure levels. The inlet valve 22 and outlet valve 24 are preferably closed while the piston 4 moves from left to right. When the piston 4 moves from right to left, the valves are actuated in the opposite manner, i.e., the fresh air (charge) flow is then determined by the inlet valve 22 and outlet valve 24, while the valves 20 and 26 are preferably closed. Suitable known phase adjustment and/or stroke adjustment devices can, of course, be used to control the inlet valves and outlet valves in such a way that the conveyed air quantity (air mass flow rate) can be adjusted to the respective operating conditions required for an internal combustion engine. As a result, the compressor can operate at a high efficiency by appropriately setting the respective opening and closing times of the valves relative to the dead centers of the piston motion.

Functional details of the representative piston compressor will be described below, wherein examples of possible modifications and additional features are indicated as well.

1. Overall Structural Shape.

Even though it only contains a cylinder and a dual-action piston arranged therein, the piston compressor according to the invention operates at a high level of efficiency and low pressure pulsations. Designing the piston with two mutually spaced piston heads, between which the crank mechanism is situated, not only has the advantage of completely separating the crankshaft and its lubrication from the workspaces, but also makes it possible to mount the crankshaft (n) in the cylinder wall without any problem. The piston compressor can have any number of cylinders with pistons operating therein as desired, wherein the individual cylinders are phase-shifted during operation, so that minimal pressure pulsations are achieved. The possible low stroke/bore ratio enables low piston speeds, which has a favorable influence on service life.

The structure allows the cross sections of the inlet and outlet valves to be enlarged relative to the cylinder cross section, so that the compressor operates at a low flow resistance.

The pressure side of the charger can be attached directly to the cylinder head or a suction tube of an engine to be charged. When attached directly to the cylinder head, the length of the housing 32 can have several exhaust ports 36 connected inside the housing 32, which ports lead directly into the inlet channels of the individual cylinders. The suction side in front of the compressor can have attached to it a suction part that contains a throttle valve, incorporates a connection for exhaust gas recirculation, or has a bypass line branching from it, which leads around the compressor directly into a suction tube of the internal combustion engine.

The structure enables a high surface-to-volume ratio relative to the stroke volume, which allows the use of large gas charging valves.

The free paths between the walls of the housing and the cylinders are short overall, so that the compressed gas is also effectively cooled while cooling the walls.

2. The Crank Mechanism:

The crank mechanism can contain one or more crankshafts, wherein the rotational motion of the crankshaft (n) can be converted into a stroke motion of the piston using a wide variety of known mechanisms. The representative mechanism, which comprises slide rings, is easy to install, involves little friction during operation, and results in a soft, sinusoidal motion of the pistons.

The representative embodiment with two oppositely rotating crankshafts can act as a Lancester offset, wherein oscillating, sinusoidal forces of gravity of the piston and slide rings in the crank mechanism of each piston are completely offset. Further, each individual cylinder is offset, so that dynamic forces of gravity are not introduced into the housing from any cylinder. In addition, there are externally acting forces of gravity outside of the housing, so that the compressor according to the present teachings operates at very low oscillation levels.

The representative embodiment of the crank pin or crank disk with mutual axial displacement provides a compact structural design on the one hand, and a low mechanical stress, and hence high torsional strength of the crank mechanism.

Another advantage is that the piston(s) move free of lateral forces, which reduces frictional loses and increases service life. The piston heads made without a shroud help to reduce the weight thereof. Furthermore, no tilting forces are encountered.

The toothed wheels 58 and 60 at the ends of the crankshafts (FIG. 4) are used for synchronization and power transfer between the crankshafts. The toothed wheels can also be replaced by winding means, such as a toothed belt. Only one crankshaft is required to be driven from one end, e.g., by means of the pulley 96 (FIG. 14).

3. Cooling/Lubrication:

The toothed wheels 58 and 60 (FIG. 4) can be used as elements in a toothed wheel pump, which can convey a cooling/lubricating fluid that circulates in the channels in the compressor or charger. At least the walls of the cylinder bordering the working chambers 10 and 12 are advantageously cooled, wherein the short thermoconducting paths ensure efficient cooling. The charger can additionally have an internal heat exchanger arranged in front of the exhaust port 36. As an alternative or in addition, the compressed air can flow through an external heat exchanger before entering the internal combustion engine.

The preferably integrated lubricant/coolant circulation system of the charger can be connected to or separate from the internal combustion engine.

One important aspect of the compressor according to the present teachings lies generally in the fact that the compressed air flowing through the exhaust port 36 has no lubricant on the one hand, and is as cool as possible on the other hand. In both instances, it is advantageous that both crankshafts, which are simultaneously camshafts, are passed through the piston heads and mounted in the cylinder 2 with easily sealable bearings, thereby forming an outwardly tight lubricant space within the piston, to which liquid lubricant that also serves as a coolant can be supplied through the crankshafts. The lubricant/coolant can effectively cool the piston heads from the inside. Of course, the channels leading through the cylinder wall, the space between the cylinder and housing, and the housing form a fluid recirculation system, so that the coolant/lubricant circulates.

Shank guides for the roller tappets 64 can be wet lubricated through the crankshafts in such a way that the lubricant does not get introduced into the fresh air. Very hard tappet shank ends or contact surface combinations are advantageous.

Material couplings that ensure low friction and wear are advantageous for attaching the valves to valve levers or, as in the example shown, to the bridge-like valve elements.

Material couplings provided with solid lubricants in a known manner or saturated with lubricants are advantageous for the guides of the roller tappets and valves. It is also possible to provide the seat rings with solid lubricant or saturate them with lubricant.

The low operating temperatures make it possible to utilize solid lubricants or saturated guide bushes, so that the circulation of liquid lubricant or coolant can be limited to the lubricant spaces within the piston.

Ceramic materials can also be used to minimize the requirement for liquid lubricants.

4. Charge Exchange Process

As explained above, the charger according to the present teachings advantageously operates in the two-cycle mode. The inlet and outlet valves can be actuated in a variety of ways. In the exemplary embodiment, they can not only be actuated via the valve elements provided with suitably dimensioned springs, but also operate as check valves, wherein the inlet valves open in response to an underpressure in the respective working chamber, and the outlet valves open in response to an overpressure. In alternative embodiments, only the inlet valves or only the outlet valves can be designed as check valves, and the other valves can be actuated by the crankshaft(s).

Even during desmodromic (compulsory control) operation of the valves, in particular the outlet valves, a self-control function can be realized if the pressure drop on the valves exceeds a predetermined value.

The inlet and/or outlet valves can also be actuated in such a way using known valve actuating mechanisms, e.g., by changing the effective length and/or angle of a contact lever, that their opening or closing function is variable, and/or they can be held in the open or closed position.

5. Open or Closed-Loop Compressor Control

The speed of the compressor crankshafts can be rigidly coupled with the crankshaft of an internal combustion engine. A gear with an incrementally or continuously adjustable transmission ratio can be arranged between the internal combustion engine to be charged and the compressor. A coupling can be used to completely decouple the compressor from the internal combustion engine.

The output capacity of the compressor can also be changed by variably actuating the valves, wherein a low-flow path from the suction port 34 to the exhaust port 36 (FIG. 1) is achieved with the valves in the open position.

As an alternative, fresh air can be supplied to the internal combustion engine via a bypass line with the compressor not operating.

Individual cylinders can be shut off as needed.

The output capacity of the charger can be changed as required using controllable openings in the separating walls 28 and 30. A throttle valve can be incorporated upstream form the inlet opening 34.

Several compressors can be parallel- or series-connected in an internal combustion engine.

In order to place even less stress on the piston heads, each crankshaft can be provided with two or more crank disks allocated to each piston.

The valves can also be actuated fully independently of the crankshaft rotation by separate drives, e.g., electromagnetic, hydraulic or other suitable drives. Only one crankshaft can extend through each piston in place of the two crankshafts, etc.

In sum, the compressor offers numerous ways of regulating the maximum amount of air compression over slight compression, no compression up to the reciprocation, when the compressor is used for braking purposes.

The compressor and/or charger according to the present teachings is suitable for charging (supplying fresh air to) all types of internal combustion engines, two-stroke engines, four-stroke engines, or engines operating with different stroke sequences, spark ignition engines, diesel engines, gas engines, etc.

Reference List

2 Cylinder
4 Piston
6 Piston head
8 Piston head
10 Working chamber
12 Working chamber
14 Brace
16 Guiding surface
17 Guiding surface
18 Slide ring
20 Inlet valve
22 Inlet valve
24 Outlet valve
26 Outlet valve
28 Separating wall
30 Separating wall
32 Housing
34 Suction port
36 Exhaust port
38 Inlet channel
40 Outlet channel
42 Crankshaft
44 Crankshaft
46 Crank disk
48 Crank disk
50 Balancing mass
52 Balancing mass
54 Cam
56 Cam
58 Toothed wheel
60 Toothed wheel
62 Roller tappet
64 Roller tappet
66 Valve element
68 Valve element
70 Spring
72 Spring
74 Guide passage
76 Recess
78 End flange
80 Valve spring
82 Stud screw
84 Guide passage
86 Stop
88 Roll
90 Guide
92 Piston compressor
94 Cylinder head
96 Belt pulley

The invention claimed is:

1. A piston compressor suitable for charging an internal combustion engine, comprising:

at least one cylinder having at least opposing first and second cylinder walls, at least one double-headed piston disposed in the at least one cylinder, the at least one double-headed piston having opposing first and second piston heads, wherein two working chambers are respectively defined between the first cylinder wall and the first piston head and between the second cylinder wall and the second piston head, each of the two working chambers having at least one inlet valve and at least one outlet valve operably coupled thereto, wherein the inlet and outlet valves are arranged and constructed such that the inlet valves and the outlet valves alternately open and close for each stroke of the double-headed piston, a housing surrounding the cylinder, the housing having a suction port and an exhaust port, a space being formed between the housing and the cylinder, which space is divided by separating walls in such a way as to form an inlet channel that joins the suction port with the inlet valves and to form an outlet channel that joins the exhaust port with the outlet valves;

two crankshafts arranged and constructed to rotate in opposite directions at the same speed and to reciprocally move the at least one double-headed piston within the at least one cylinder, wherein the two crankshafts extend perpendicularly to the moving direction of the piston between the first and second piston heads of the at least one double-headed piston, through the at least one cylinder and at least partially through the housing; and at least two sliding blocks disposed on a crankshaft-facing surface of each of the first and second piston heads, each sliding block being slidably movable perpendicular to the reciprocating movement of the at least one double-headed piston and engaging at least one eccentrically-mounted crank disk formed on a respective end of the two crankshafts.

2. A piston compressor according to claim 1, wherein one of the crankshafts is externally drivable and engages the other crankshaft in a rotation-transmitting manner.

3. A piston compressor according to claim 2, wherein the respective eccentrically-mounted crank disks of the two crankshafts are axially offset relative to each other and radially overlap each other.

4. A piston compressor according to claim 3, wherein at least one of the valves is operable by at least one crankshaft.

5. A piston compressor according to claim 3, further comprising an actuating mechanism for operating at least one of the valves independently of the reciprocating piston motion.

6. A piston compressor according to claim 4, wherein each crankshaft comprises at least one cam arranged and constructed to reciprocally move a valve element movably disposed on the housing, wherein a shaft of at least one inlet or outlet valve is movably supported by the valve element, and a spring elastically biases the at least one inlet or outlet valve with respect to the valve element such that the at least one inlet or outlet valve is actuatable by the valve element while still being movable independently of the valve element.

7. A piston compressor according to claim 6, wherein a toothed wheel is connected to each crankshaft in a torsion-resistant manner, the toothed wheels engaging each other and serving as a pumping element of a cooling and/or lubricating system of the compressor.

8. A piston compressor according to claim 1, comprising two or more cylinders incorporated in the housing, wherein at least one double-headed piston is disposed in each cylinder and the plurality of double-headed pistons are reciprocally movable by the two crankshafts.

* * * * *